United States Patent [19]

Yang et al.

[11] Patent Number: 4,534,145

[45] Date of Patent: Aug. 13, 1985

[54] ATTACHMENT DEVICE FOR SECURING FLEXIBLE SHEETS

[75] Inventors: James H. C. Yang, Cleveland; Walter Tomaszewski, Canton; Heinz W. Benezé, Akron, all of Ohio

[73] Assignee: The Firestone Tire & Rubber Company, Akron, Ohio

[21] Appl. No.: 516,618

[22] Filed: Jul. 25, 1983

[51] Int. Cl.[3] ..... E04B 1/00

[52] U.S. Cl. ..... 52/222; 52/273; 52/461; 160/395

[58] Field of Search ..... 52/222, 273, 461–467; 160/392, 395; 72/379; 29/522; 244/132

[56] References Cited

U.S. PATENT DOCUMENTS

| | | | |
|---|---|---|---|
| 166,059 | 7/1875 | Atha . | |
| 1,484,382 | 2/1924 | Allitt | 160/392 |
| 2,164,414 | 7/1939 | Long | 29/522 |
| 3,757,479 | 11/1973 | Martinez | 52/222 |
| 3,893,212 | 7/1975 | Curry . | |
| 3,928,897 | 12/1975 | Tombu . | |
| 4,107,826 | 8/1978 | Tysdal | 160/395 |

FOREIGN PATENT DOCUMENTS

| | | | |
|---|---|---|---|
| 952386 | 5/1949 | France | 72/379 |
| 625463 | 9/1961 | Italy | 160/392 |
| 597518 | 1/1948 | United Kingdom | 52/461 |

*Primary Examiner*—James L. Ridgill, Jr.
*Attorney, Agent, or Firm*—Ernst H. Ruf

[57] ABSTRACT

An attachment device for securing a flexible sheet within a channel member via an insert member of generally inverted V-shape wherein the latter is made of a ductile but rigid material having a central longitudinal portion of reduced rigidity that serves to define two adjacent wing portions and permits the subsequent plastic deformation of the insert member into its installed shape after its insertion, together with the flexible sheet, into the channel member. A method for securing the flexible sheet within the channel member, via the ductile but rigid member, is also presented.

22 Claims, 9 Drawing Figures

ATTACHMENT DEVICE FOR SECURING FLEXIBLE SHEETS

TECHNICAL FIELD

The field of art to which this invention pertains is that of mechanical fastening systems, particularly to an attachment device and method for mechanically securing a flexible sheet, without puncturing same, within a channel member via a ductile but rigid insert member adapted for fixably retaining the sheet within the channel member.

BACKGROUND OF THE ART

A large number of commercial and factory or plant roofs are of a flat roof design wherein the roofing material itself is often of a built-up asphalt and, in more modern systems, of a single ply EPDM elastomeric sheet or membrane. In terms of securing a single ply EPDM membrane to the roof itself, one common design utilizes a mechanical ballast system that uses a layer of stone over the membrane. While the ballast system is least expensive, it has the disadvantage of being quite heavy (ten pounds per square foot) thus requiring a heavy roof support structure and, in addition, the roof slope cannot exceed 10°.

Adhered roof membrane retention systems suffer from a cost penalty while mechanical fastening systems generally require a fixation to the roofing substrate by metal fasteners with metal or rubberized nailing strips. Additional sealing strips or caps are then required to keep the punctured membrane water tight. Such installations are cumbersome as well as time-consuming in addition to violating the integrity of the membrane itself.

DISCLOSURE OF THE INVENTION

The present invention provides a solution to the noted prior art problems and constructions by permitting attachment of a flexible sheet or membrane to a substrate or support without either press fitting or puncturing the membrane.

The attachment device of the present invention mechanically secures a flexible sheet or membrane to a channel member, having a central longitudinal slot, via a ductile but rigid insert member wherein the channel member is of a generally rectangular form in transverse cross-section.

The insert member utilized for retaining the flexible sheet is made of a ductile but rigid material and has an integral central longitudinal portion of reduced rigidity that serves to define two adjacent wing portions of an essentially inverted V-shape in transverse cross section that permit the plastic deformation of the insert member into a substantially flat or slightly concave shape after insertion of the insert member, together with the flexible sheet, into the channel member.

The insert member portion of reduced rigidity also acts as a hinge member after the noted insertion so that, upon the application of tensile forces to the flexible sheet, the insert member tends to assume an even more pronounced generally flat or greater concave shape which in turn enhances its retention capabilities within the channel member.

Relationships pertaining to channel member and insert member dimensions are set forth together with ratios and several equations to fully define the invention.

The method for mechanically securing the flexible sheet within the channel member, via the ductile but rigid insert member, includes the steps of initially extending the flexible sheet over the channel member top surface; placing the insert member, together with the flexible sheet, through the channel member slot; and plastically deforming the insert member, within the channel member, to a substantially flat or slightly concave shape so as to frictionally and yet non-bindingly retain the sheet within the channel member.

Other features and the advantages of the present invention will become more readily understood by persons skilled in the art when following the best mode description in conjunction with the several drawings.

BEST MODE FOR CARRYING OUT THE INVENTION

Figure 1:
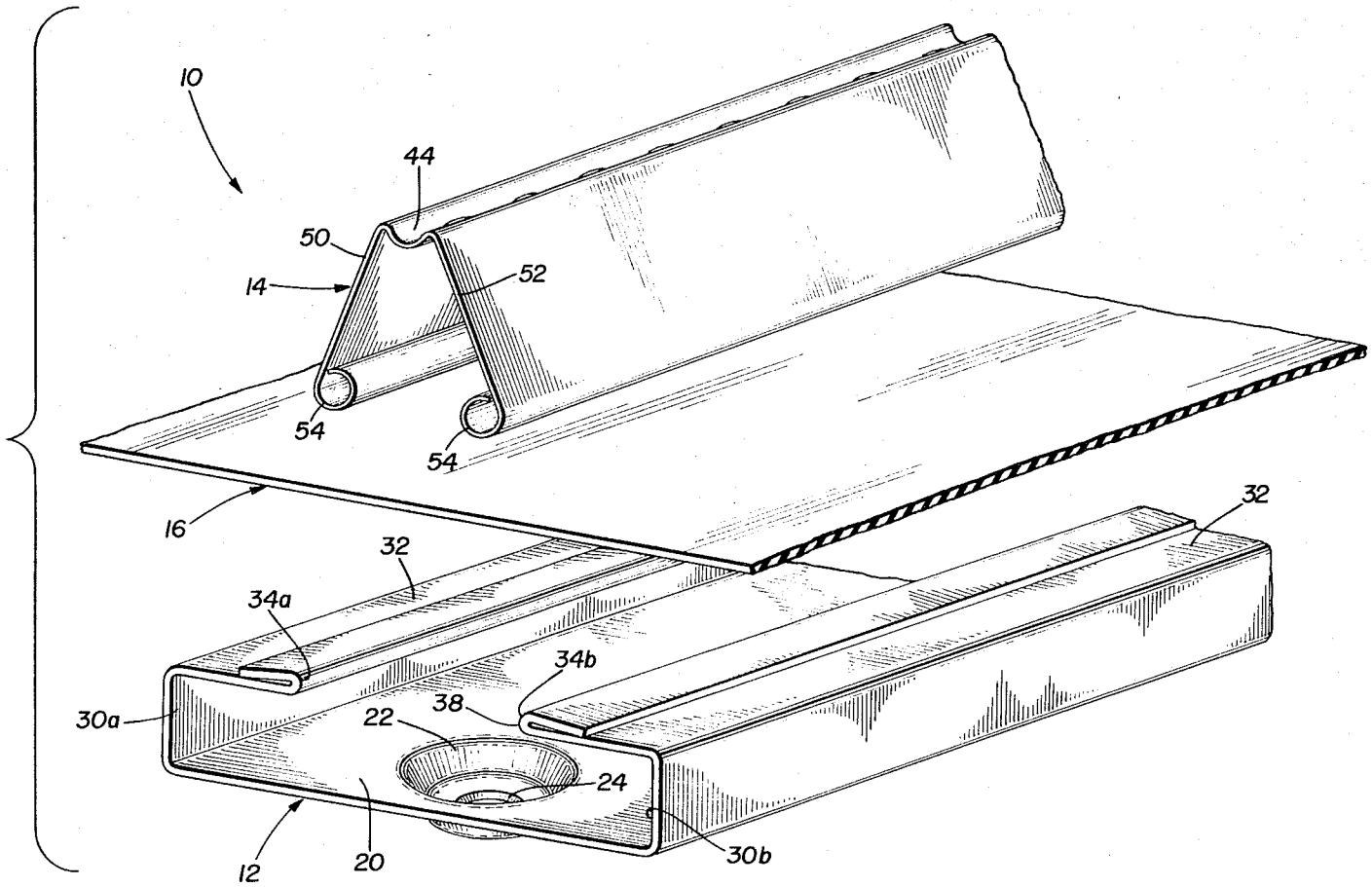
FIG. 1 is an exploded view, in enlarged perspective, of the attachment device of the present invention.

Referring now to the drawings, specifically FIG. 1, there is illustrated an exploded view, in enlarged perspective of the attachment device 10 of the present invention. Attachment device 10, which basically includes channel member 12 and insert member 14, is utilized for securing a portion of a flexible sheet 16, interposed therebetween, in a manner to be described hereinafter.

Figure 3:
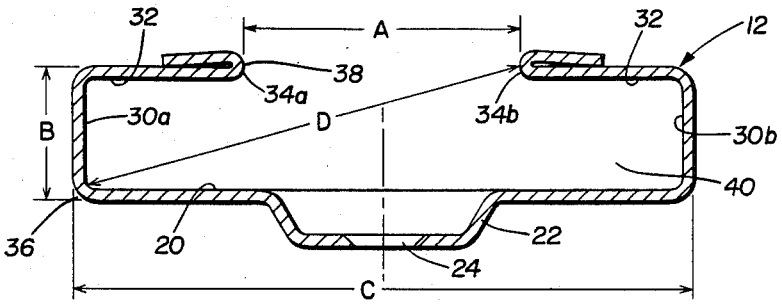
FIG. 3 is a cross-sectional view of the channel member of the present invention.
Figure 5:
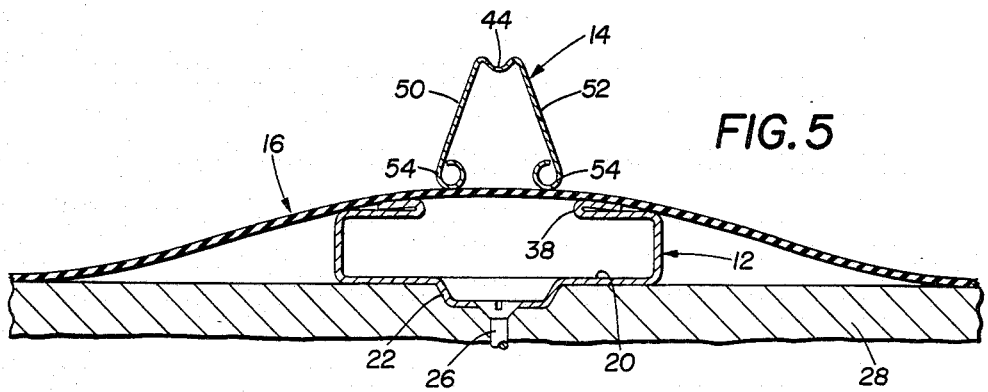
FIG. 5 is a cross-sectional view of the channel member, flexible sheet and insert member, wherein the flexible sheet extends over the channel member and the insert member has been positioned over the flexible sheet to permit insertion thereof into the channel member.
Figure 6:
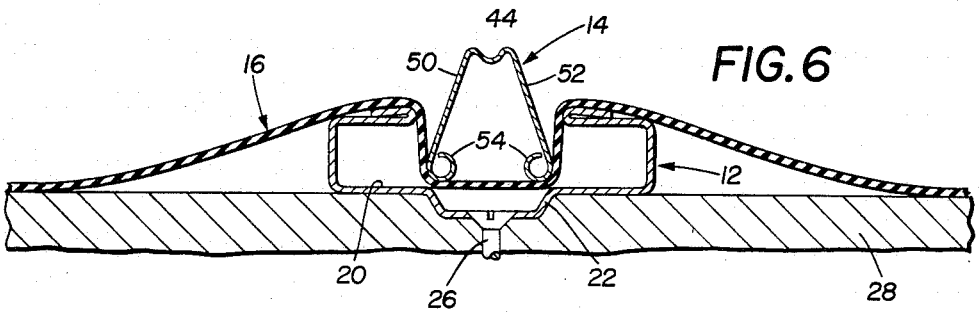
FIG. 6 is a view similar to that of FIG. 5 but showing the flexible sheet and insert member partially inserted within the channel member prior to pushing down the apex of the insert member.
Figure 7:
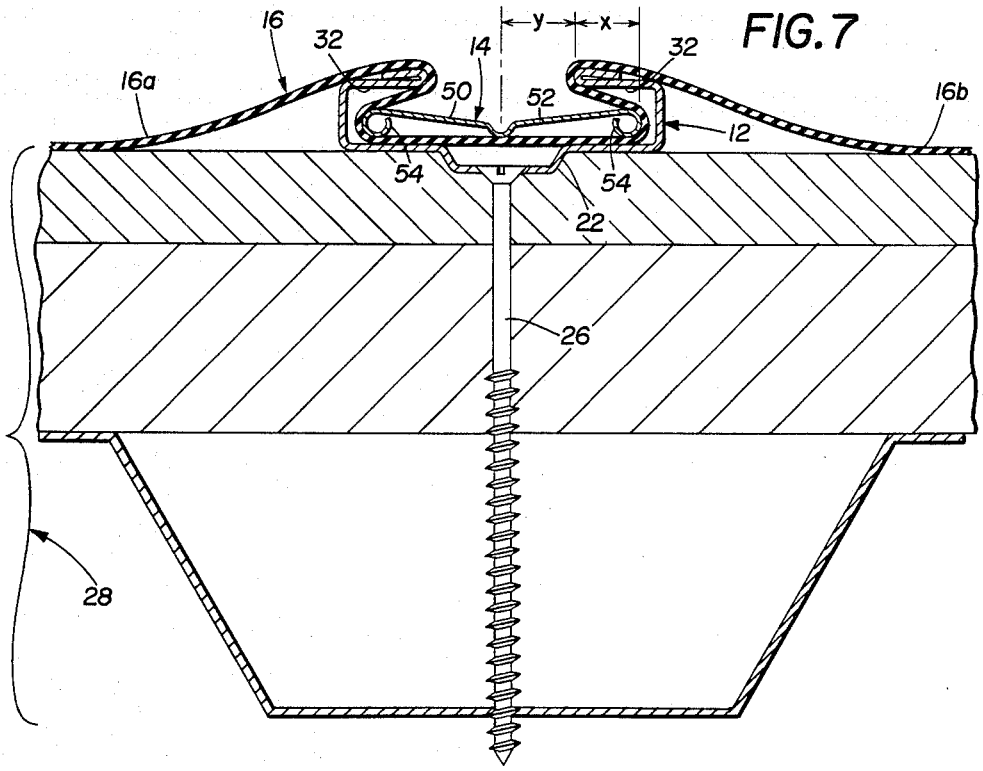
FIG. 7 is a view similar to FIG. 6 but showing the insert member fully inserted and securing the flexible sheet within the channel member.

Channel member 12, as best seen in FIGS. 1 and 3 and usually of a rigid, preferably metal construction, is of generally rectangular form in transverse cross section (see FIG. 3) having a substantially flat bottom wall 20 which in turn is provided with a plurality (one shown) of longitudinally spaced outwardly directed protrusions or recesses 22 that are provided with a central aperture 24, the latter permitting the partial passage therethrough of a fastener, such as 26, shown in FIGS. 5–7. The ends of channel bottom wall 20 merge into opposed, similarly projecting sidewalls 30*a*, 30*b*, which in turn merge into inwardly converging spaced top wall 32, parallel to bottom wall 20, whose opposite inner but spaced smooth edges 34*a*, 34*b* serve to define a constricted central longitudinal slot or opening 38.

The cross sectional area 40 within channel member 12 (excluding protrusions 22) as best seen in FIG. 3, can be defined as having a predetermined width C (between opposed walls 30*a*, 30*b*) a predetermined height B (between bottom and top walls 20, 32 respectively), with the opening in top wall 20 (slot 38) being of a predetermined width A.

Figure 4:
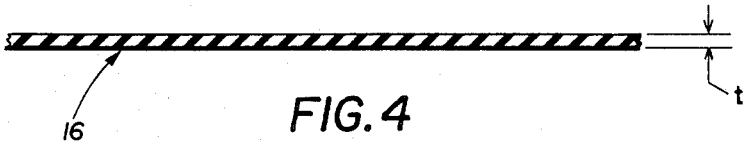
FIG. 4 is a cross-sectional view of the flexible sheet that is retained by the attachment device of the present invention.

In order to permit the insertion of sheet 16 into the interior of channel member 12, sheet 16 must be at least flexible and is preferably elastic. Sheet or membrane 16 may, for example as shown in FIG. 4, be EPDM (Ethylene Propylene Diene Monomer) roofing sheeting having a predetermined thickness t.

Figure 2A:
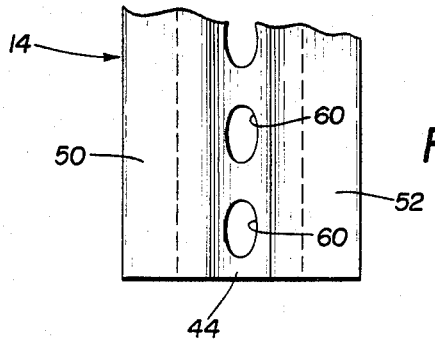
FIG. 2*a* is a fragmentary top plan view of the insert member of the present invention.
Figure 2B:
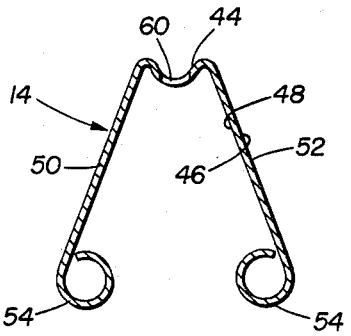
FIG. 2*b* is a cross-sectional view of the insert member of the present invention in its uninstalled or free state, showing its inverted V-shape.
Figure 2C:
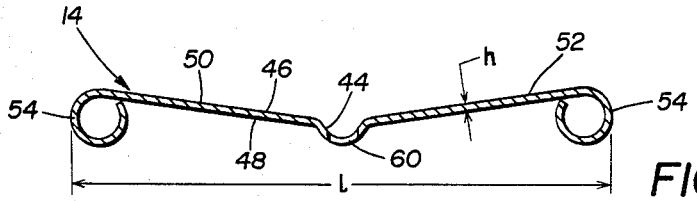
FIG. 2*c* is a view similar to that of FIG. 2*b* but showing the insert member in its installed state.

Turning now to insert member 14, best seen in FIGS. 1, 2*a* and 2*b*, it is preferably constructed of a ductile but rigid material such as for example galvanized mild steel. Other rigid, preferably metallic materials can also be utilized. Insert member 14, which is of generally inverted V-shape in transverse cross-section (FIG. 2*b*), has a central longitudinal portion 44 of reduced rigidity that also serves to define two adjacent substantially opposed allochiral wing portions 50, 52. Portions 50 and 52 may be either flat or slightly concavely curved. The maximum depth of portion 44, which may be slightly curved, is approximately three to four times the predetermined thickness h of insert member 14, with smooth curved end portions 54, having a radius of about three to four times h. Portions 44 and 54 preferably extend in the same direction. The top and bottom surfaces of member 14 are designated by numerals 46 and 48 respectively. The nominal lateral or transverse installed extent of insert member 14 has a predetermined extent 1, as best seen in FIG. 2*c*. In its free state, as best seen in FIG. 2*b*, its maximum traverse extent should not exceed the value of A−4t.

Portion 44 not only serves to define the two adjacent wing portions 50, 52 but is also of reduced rigidity, this being achieved via a plurality of spaced apertures 60, of any desired shape, which tend to weaken portion 44. This weakening enhances the plastic deformation of insert member 14 from its inverted V-shape to its installed shape after its insertion, together with flexible sheet 16, into channel member 12 in the manner to be described with reference to FIGS. 5, 6 and 7.

Prior to the description relative to the insertion of insert member 14 and flexible sheet 16 into channel member 12, the relationships between previously discussed dimensions A, B, and C, are governed by the following equations:

The nominal channel slot width (A) complies with the equation:

$$A=2l-C-K_3h \quad (1)$$

wherein: $l$=nominal installed transverse extent of the insert member

C=nominal channel width of the channel member h=nominal thickness of the insert member $K_3$=a material constant of the insert member. This constant is a preferably experimentally determined dimensionless number related to the modulus of elasticity and stiffness of the material from which the insert member is made. The stiffer the material, the shorter need be the portion of the insert member wing portion, represented by dimension x in FIG. 7, supported or covered by channel member top wall 32, relative to the unsupported wing portion, represented by dimension y in FIG. 7. In one example, the solving of equation (1) for $K_3$, using actual physical dimensions and the previously-noted galvanized mild steel, the value of $K_3$ was determined to be 28.75.

The nominal channel height (B) complies with the equation:

$$B=7.8h+4t+K_1 \quad (2)$$

wherein:

h=nominal dimensional thickness of the insert member.

t=nominal thickness of the flexible sheet $K_1$=dimensional manufacturing and clearance tolerances (such as for example 0.01/0.03")

The nominal channel width (C) complies with the equation:

$$C=l+4t+K_2 \quad (3)$$

wherein:

$l$=nominal installed transverse extent of the insert member t=nominal thickness of the flexible sheet $K_2$=dimensional manufacturing and clearance tolerances (such as for example 0.01/0.03").

The preferred ratio of the thickness to the installed transverse extent of insert member 14 is about 0.01. As noted, the preferred ratio of the depth of the portion 44 to thickness t of member 14 is about 3–4. In addition, the preferred ratio of the slot width (A) to the channel width (C) of channel member 12 is about 0.42. Further yet, the preferred ratio of the channel height (B) to the channel width (C) of channel member 12 is about 0.2; and the preferred ratio of the channel height (B) to the slot width (A) of channel member 12 is about 0.46. It should also be understood that dimension D, extending diagonally from the intersection 36 of sidewall 30*a* and bottom wall 20 to the smooth remote edge 34*b* of top wall 32, is less than the transverse extent (2) of insert member 14.

The relationship of channel member dimensions A, B and C is such that it will allow the insertion of not only a single sheet of flexible sheet 16 (which requires channel member 12 to accommodate a top and bottom layer of sheet 16 relative to wing portions 50, 52, as best seen in FIG. 7) but even of dual sheets which will of necessity provide two top and bottom layers of sheet 16 relative to the noted wing portions. Such a doubling can occur in the case of a lap splice between separate sheets 16, if such a splice falls within channel area 40, be it parallel with the longitudinal extent of channel member 12 or perpendicular thereto.

This is why in equation (2), namely $B=7.8h+4t+K_1$, pertaining to the nominal channel height (B), the multiplier 4 is used with factor t (nominal thickness of the flexible sheet). It is also within the scope of the invention to mechanically join two separate sheets 16 by overlapping same within at least a portion of the longitudinal extent of channel area 40, such as for example by overlapping such sheets in the area between insert member bottom surface 48 and channel bottom wall 20.

The description relative to the method of mechanically securing sheet 16 in channel member 12, via insert member 14 will be made relative to FIGS. 5, 6 and 7.

Turning first to FIG. 5, it depicts channel member 12 attached to any desired type of substrate 28 (best shown in FIG. 7), such as a roofing structure, via a plurality of fasteners 26. After flexible sheet or membrane 16 is placed over channel member 12, inverted V-shape insert member 14 is situated thereabove and in alignment with slot 38. Insert member 14, together with sheet 16 is then pushed or placed vertically into channel member 12 through central longitudinal opening 38 until sheet 16 touches channel member bottom wall 20 in the manner shown in FIG. 6. Thereafter pressure is applied downwardly against the portion 44 (forming the apex of the inverted V) to plastically deform insert member 14 from its inverted V-shape to its installed shape—either substantially flat or preferably into a slightly concave shape as best seen in FIGS. 2*c* and 7. The important thing is that after insert member 14 is received within channel member 12, that it must either remain substantially flat or slightly concave since a convex curvature can cause it to be ejected from channel member 12 upon the application of sufficient tensile forces, either parallel and/or perpendicular to top wall 32, on either one or both of sheet ends 16*a*, 16*b*.

It is thought that the mode of operation of insert member 14, according to the invention, consists of the fact that when a tensile force acts at one of sheet ends 16*a*, 16*b*, either parallel to or perpendicular to top wall 32, this tensile force is transmitted, by insert member 14, acting as a beam, to the opposite end 54 of insert member 14 to thereby press its associated portion of sheet 16 against the inner surface of channel member wall portion 30*a*, 30*b*. The frictional forces present between these parts, when in contact with each other, prevents sheet 16 from sliding out of channel member 12 after insert member 14 is inserted. If perpendicular or opposed parallel tensile forces are applied on both sheet ends 16*a*, 16*b*, insert member 14 is drawn upward so that sheet 16 is frictionally retained between member 14 and the inner surfaces of top wall 32 and bottom wall portion 48, in at least the area below portion 44, will retain sheet 16 against bottom wall 20.

It should be understood at this time that since the installed transverse extent 1 of insert member 14 is greater than dimension D of channel member 12, the former cannot be inserted into channel 12 diagonally even by itself let alone with the addition of sheet 16. Of course, the subsequent diagonal removal is therefore also not possible. It is important to note however that even in the case of a sheet lap splice falling within channel area 40 there is no press or interference fit as such of sheet 16 and insert member 14 relative to channel member 12. As best seen in FIG. 7 there can be a limited amount of lateral and/or vertical shifting of sheet 16 and member 14 within member 12. Therefore, the noted retention is due to frictional forces, not interference or press fitting.

It is also important to note that insert member portion 44, not only aids in the plastic deformation of insert member 14 during its insertion into channel member 12 but also acts as a hinge member, after the noted insertion, upon the application of the previously-noted tensile forces, thereby causing member 14 to assume an even more pronounced generally flat or greater concave shape, which in turn will enhance its retention capabilities within channel member 12.

The attachment device for securing flexible sheets of the present invention finds specific utility in mechanically securing EPDM sheeting in flat roofing applications. However, from the foregoing description, when read in the light of the several drawings, it is believed that those familiar with the art will readily recognize and appreciate the novel concepts and features of the present invention. Obviously, while the invention has been described in relation to only a limited number of embodiments, numerous variations, changes, substitutions and equivalents will present themselves to persons skilled in the art and may be made without necessarily departing from the scope and principles of this invention. As a result, the embodiments described herein are subject to various modifications, changes and the like without departing from the spirit and scope of the invention with the latter being determined solely by reference to the claims appended hereto.

What is claimed is:

1. An attachment device for mechanically securing at least one flexible elastomeric sheet to the upper surface of a roof, said attachment device comprising:

(a) a substantially rigid channel member having a generally rectangular cross-section and a continuous, central longitudinal slot opening into said channel member, a bottom wall, an upper wall, and generally opposed sidewalls, said channel member having a width which is defined by said opposed sidewalls; and (b) an insert member comprising means for maintaining said at least one flexible elastomeric sheet within said channel member, said insert member being formed from a ductile and rigid material and having an integral central longitudinal portion of reduced rigidity and two adjacent wing portions located on opposed edges of said central longitudinal portions, said central longitudinal portion defining said two adjacent wing portions and comprising means for facilitating the plastic deformation of said insert member from a first position to a second position, said insert member having a generally inverted V-configuration in said first position with said central longitudinal portion being located at the apex of said inverted V, and occupying said second position after undergoing a plastic deformation during insertion of said insert member together with said at least one flexible sheet into said channel member, said insert member being either substantially flat or slightly concave in said second position and comprising means for frictionally and non-bindingly maintaining said at least one elastomeric sheet against one wall of said channel member, thereby permitting lateral and vertical shifting of said insert member, and said at least one flexible sheet within said channel member, said insert member having a width when in said second position which is less than said channel member width.

2. The attachment device of claim 1 wherein the ratio of the thickness of said insert member to the transverse extent of said insert member is about 0.01.

3. The attachment device of claim 1 wherein the ratio of the slot width to the channel width of said channel member is about 0.42.

4. The attachment device of claim 1 wherein the ratio of the channel height to the channel width of said channel member is about 0.2.

5. The attachment device of claim 1 wherein the ratio of the channel height to the slot width of said channel member is about 0.46.

6. The attachment device of claim 1 wherein the nominal channel height (B) complies with the equation:

$$B=7.8h+4t+K_1$$

wherein:

h=nominal thickness of the insert member t=nominal thickness of the flexible sheet $K_1$=dimensional manufacturing tolerance.

7. The attachment device of claim 1 wherein the nominal channel width (C) complies with the equation:

$$C=l+4t+K_2$$

wherein:

$l$=nominal installed transverse extent of the insert member $t$=nominal thickness of the flexible sheet $K_2$=dimensional manufacturing tolerance.

8. The attachment device of claim 1 wherein the nominal channel slot width (A) complies with the equation:

$$A=2l-C-K_3h$$

wherein:

$l$=nominal installed transverse extent of the insert member

C=nominal channel width of the channel member $K_3$=dimensionless material constant of the insert member h=nominal thickness of the insert member.

9. The attachment device of claim 1 further comprising at least one elastomeric sheet securely maintained within said channel member when said insert member is in its second position.

10. The attachment device of claim 1 where in the reduced rigidity portion of said insert member comprises a hinge when said insert member is subjected to tensile forces when in said second position, thereby causing said insert member to assume a more pronounced flat or concave shape.

11. The attachment device of claim 1 wherein said channel member has a substantially flat bottom wall, wherein said opposed sidewalls are similarly projecting, and wherein said top wall is parallel to said bottom wall.

12. The attachment device of claim 11 wherein said central longitudinal slot is in said top wall.

13. The attachment device of claim 12 wherein the opposite edges of said top wall, which define said central longitudinal slot are smoothly contoured.

14. The attachment device of claim 1, wherein said central longitudinal portion of reduced rigidity is slightly curved in transverse cross section.

15. The attachment device of claim 14 wherein said central longitudinal portion of reduced rigidity includes a plurality of spaced apertures.

16. The attachment device of claim 14 wherein the maximum depth of said portion of reduced rigidity is about three to four times the thickness of said insert member.

17. The attachment device of claim 1 wherein said wing portions have outer ends which are smoothly curved.

18. The attachment device of claim 17 wherein said wing outer end portions have a radius of about three or four times the thickness of said insert member.

19. The attachment device of claim 17 wherein said central longitudinal portion of reduced rigidity is slightly curved and wherein this curvature and the curved outer ends of said wing portions extend in the same direction.

20. A method for mechanically securing at least one flexible sheet to the upper surface of a roof by an attachment device which includes a channel member and an insert member, said channel member having a substantially rectangular cross-section, an upper wall, a bottom wall, generally opposed sidewalls, and a continuous central longitudinal slot in said upper wall, and means for receiving a fastening element to attach said device to said upper roof surface, wherein said channel member is substantially rigid and has a width which is defined by said opposed sidewalls, said insert member being formed from a ductile and rigid insert member having a generally inverted V-configuration, as viewed in transverse cross-section, said insert member being adapted to be plastically deformed into a second position in which said insert member retains said at least one flexible sheet within said channel member, said channel width being greater than the width of said insert member when in said second position, said method comprising:

(a) positioning said at least one flexible sheet over the top surface of said channel member;

(b) inserting said generally inverted V-shaped insert member, together with said at least one flexible sheet, through said slot and at least partially into said channel member; and (c) plastically deforming said insert member within said channel member to either a substantially flat or a slightly concave shape so that said insert member will occupy a second position in which it frictionally and non-bindingly retains said sheet within said channel member, thereby permitting lateral and vertical shifting of said insert member and said at least one flexible sheet within said channel member, said insert member, when placed in said second position, having a width less than the width of said channel member.

21. The method of claim 20 wherein said inserting and defoming steps are carried out substantially simultaneously.

22. The method of claim 20 wherein said deforming step consists of pressing on the apex of said inverted V-shaped insert member.

* * * * *